US006640072B2

(12) United States Patent
Inoue

(10) Patent No.: US 6,640,072 B2
(45) Date of Patent: Oct. 28, 2003

(54) IMAGE FORMING APPARATUS INCLUDING AN IMAGE BEARING MEMBER AND A CHARGING MEMBER FEATURING A CONTROLLED PERIPHERAL VELOCITY DIFFERENCE THEREBETWEEN DURING CHARGING

(75) Inventor: Ryo Inoue, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/003,235

(22) Filed: Dec. 6, 2001

(65) Prior Publication Data

US 2002/0076239 A1 Jun. 20, 2002

(30) Foreign Application Priority Data

Dec. 8, 2000 (JP) ..... 2000/374255

(51) Int. Cl.[7] ..... G03G 15/00

(52) U.S. Cl. ..... 399/167; 399/50; 399/149; 399/175

(58) Field of Search ..... 399/168, 167, 399/174, 175, 50, 149

(56) References Cited

U.S. PATENT DOCUMENTS

| | | | | |
|---|---|---|---|---|
| 5,426,488 A | * | 6/1995 | Hayakawa et al. | 399/174 |
| 5,532,795 A | * | 7/1996 | Tatsumi et al. | 399/167 |
| 5,576,807 A | * | 11/1996 | Osawa et al. | 399/175 |
| 5,576,808 A | * | 11/1996 | Ikegawa et al. | 399/175 |
| 5,708,932 A | * | 1/1998 | Yano et al. | 399/175 |
| 5,768,653 A | * | 6/1998 | Fare | 399/50 |
| 5,805,960 A | | 9/1998 | Suzuki et al. | 399/149 |
| 5,809,379 A | | 9/1998 | Yano et al. | 399/159 |
| 5,835,821 A | * | 11/1998 | Suzuki et al. | 399/174 |
| 6,035,162 A | * | 3/2000 | Chigono | 399/175 |
| 6,081,681 A | | 6/2000 | Nagase et al. | 399/174 |
| 6,118,965 A | * | 9/2000 | Hirabayashi et al. | 399/175 |
| 6,128,456 A | | 10/2000 | Chigono et al. | 399/176 |
| 6,134,407 A | | 10/2000 | Ishiyama et al. | 399/174 |
| 2001/0026695 A1 | * | 10/2001 | Uno | 399/50 |

FOREIGN PATENT DOCUMENTS

| | | |
|---|---|---|
| JP | 5-100535 | 4/1993 |
| JP | 9-96948 | 4/1997 |
| JP | 10-307458 | 11/1998 |

* cited by examiner

*Primary Examiner*—Susan S. Y. Lee
(74) *Attorney, Agent, or Firm*—Fitzpatrick, Cella, Harper & Scinto

(57) ABSTRACT

An image forming apparatus includes an image bearing member, a charging member, disposed so as to be contactable with the image bearing member, for charging the image bearing member with a peripheral velocity difference between the charging member and the image bearing member, and a controller for variably controlling the peripheral velocity difference at the time when an area which becomes an image forming area of the image bearing member is charged by the charge member.

42 Claims, 5 Drawing Sheets

IMAGE FORMING APPARATUS INCLUDING AN IMAGE BEARING MEMBER AND A CHARGING MEMBER FEATURING A CONTROLLED PERIPHERAL VELOCITY DIFFERENCE THEREBETWEEN DURING CHARGING

BACKGROUND OF THE INVENTION

1. Field of the Invention

The present invention relates to an image forming apparatus that has a charging member for contacting an image bearing member to charge it, in which a peripheral velocity difference is formed between the image bearing member and the charging member.

2. Related Background Art a) Transfer-type Image Forming Apparatus

A transfer-type image forming apparatus is an apparatus with a system and configuration for causing a first image bearing member such as an electrophotographic photosensitive member and an electrostatic recording dielectric to form and bear a transferable image in an appropriate image forming process such as an electrophotographic process and an electrostatic recording process and to transfer the transferable image to a second image bearing member and repeatedly using the first image bearing member for image formation.

For example, an image forming apparatus such as a copying machine/laser beam printer utilizing a transfer electrophotographic process basically has an electrophotographic photosensitive member as a first image bearing member, which is generally a rotary drum type, charging means for uniformly charging the surface of the rotary photosensitive member in predetermined polarity and potential, image exposing means for forming an electrostatic latent image (electronic latent image) on a charging processing surface of the rotary photosensitive member, developing means for developing the electrostatic latent image as a toner image, transferring means for transferring the toner image from the surface of the photosensitive member to transfer paper as a second image bearing member, fixing means for fixing the toner image transferred to the transfer paper side as a permanently fixed image and photosensitive member cleaning means (cleaner) for removing transfer residual toner from the surface of the rotary photosensitive member, from which the toner image has been transferred to the transfer paper side, to clean the surface of the photosensitive member.

The transfer paper that was subjected to an image fixing processing by the fixing means is discharged as a product on which an image is formed (copy, print). The surface of the photosensitive member cleaned by the cleaning means serves image formation repeatedly.

b) Contact Charging Means

As charging means for uniformly charging a surface of a photosensitive member in predetermined polarity and potential, a corona charger has been conventionally used.

The corona charger is disposed non-contactingly opposing a charged member and exposes the surface of the charged member to a corona shower discharged from the corona charger, to which a high pressure is applied, to charge the surface in predetermined polarity and potential.

Instead, a contact electrifying apparatus has been put to practical use in recent years. This causes a conductive charging member of a roller type (charging roller), a fur brush type, a magnetic brush type, a blade type and the like to contact a photosensitive member as a charged member and applies a predetermined charging bias to it to charge the surface of the photosensitive member in predetermined polarity and potential. The contact electrifying apparatus has advantages in terms of low ozone, low electric power and the like compared with the corona charger.

As a method of applying a charging bias to a contact charging member, there are a DC bias method for applying only a direct current bias and an AC bias method for superimposing a direct current bias on an alternating current bias to apply the superimposed bias.

Two types of charging systems, namely a corona charging system and a contact injection charging system (direct charging system) are mixed in a charging mechanism (mechanism of charging, charging principle) of contact charging. Respective properties emerge depending on which one is more predominant.

The corona charging system is a system for using a discharge phenomenon such as the corona discharge that occurs in a microscopic gap between a contact charging member and a charged member to charge the charged member with a product of discharge. This corona charging system produces a small amount of ozone although it is significantly less than that in the case of the corona charger.

The contact injection charging system is a system in which a charge is directly injected in a charged member from a contact charging member, whereby the surface of the charged member is charged. This is also called direct charging or injection charging.

In U.S. Pat. No. 5,809,379 and the like, there is proposed a method of injecting a charge via a charging roller, a charging brush, a magnetic brush formed of conductive magnetic particles, or a contact charging member or the like of conductive particulates or the like carried on a roller to perform the contact injection charging.

Since the contact injection charging does not use the discharge phenomenon, a voltage required for charging is equivalent to only a desired surface potential of a photosensitive member and does not produce ozone. Thus, it is an ozoneless and low power charging method.

Since the contact injection charging does not use the discharge phenomenon in a microscopic gap, its charging capability and charging uniformity largely depend on a probability of contact between a surface of a photosensitive member and a charging member. It is a general practice to give a velocity difference between the surface of the photosensitive member and the contact charging member in order to increase this probability of contact.

c) Cleanerless (Cleanerless Process, Toner Recycle Process)

For the transfer-type image forming apparatus, there is proposed a method of causing an electrifying apparatus or a developing apparatus to perform cleaning (removal) of residual toner after transfer (transfer residual toner) on a photosensitive member without specifically providing a special purpose cleaner for compactness of the apparatus, reduction of costs, ecology and the like (cleaning simultaneous with charging or cleaning simultaneous with development).

That is, in a general transfer-type image forming apparatus, transfer residual toner remaining on a photosensitive member after transfer is removed from the surface of the photosensitive member by a special purpose cleaner to be waste toner. However, it is preferable from the viewpoint of maintenance or ecology that the waste toner is not produced.

Thus, there has been developed a cleanerless image forming apparatus with a configuration in which a cleaner is eliminated and a transfer residual toner on a photosensitive member after transfer is removed from the surface of the photosensitive member through the cleaning simultaneous with development by a developing apparatus and collected in the developing apparatus for reusing. That is, the developing apparatus also works as a cleaner for collecting transfer residual toner remaining on the photosensitive member after a toner image is transferred to a transferring material.

The cleaning simultaneous with development is a method of collecting toner remaining on a photosensitive member after transfer by a fog removing bias (a fog removing potential difference $V_{back}$ that is a potential difference between a direct current voltage to be applied to a developing apparatus and a surface potential of the photosensitive member) at the time of development in the next and subsequent processes. According to this method, since the transfer residual toner is collected in the developing apparatus and reused in the next and subsequent processes, waste toner is not discharged. In addition, since it is cleanerless, there is a significant advantage in terms of space and compactness, reduction of costs and the like of an image forming apparatus can be realized.

d) Contact Charging, Transfer and Cleanerless Image Forming Apparatus

In a transfer and cleanerless image forming apparatus, if a contact electrifying apparatus is adopted as charging means of a photosensitive member as an image bearing member, a positive ghost due to poor collection of transfer residual toner in a developing apparatus can be suppressed by a scattering effect of the transfer residual toner by a charging member that contacts the photosensitive member. Since it is cleanerless, there are such advantages that there is no damage on the surface of the photosensitive member due to a cleaning member contactingly sliding on the surface of the photosensitive member.

In magnetic brush charging using a magnetic brush charging member (magnetic brush charger) having a magnetic brush portion, which is formed in a brush shape by magnetically binding conductive magnetic particles, as a charging member, the magnetic brush charging member is unlikely to suffer from an effect of toner mixture compared with other charging members such as a conductive rubber roller and a fixed or rotary fur brush and is preferably used in a cleanerless process.

In addition, in a particle charging method for contactingly charging a photosensitive member via nonmagnetic and conductive particulates (charging particles, charging accelerating particles) carried on a roller disclosed in, for example, U.S. Pat. Nos. 6,081,681, 6,128,456 and 6,134,407, Japanese Patent Application Laid-Open No. 10-307458 and the like, there is described a method of externally adding conductive particulates to toner of a developing apparatus in advance and developing the conductive particulates with the toner, thereby supplying the conductive particulates to the roller to realize a cleanerless process.

In the contact injection charging method, due to a characteristic that a charge is only injected in a part which a charging member of an image bearing member contacts, when the charging member is contaminated by toner, its added agent or the like, contact of the charging member and the image bearing member is prevented and charge injection in the image bearing member is hindered. As a result, voltage drop or charging unevenness is caused. The former can be solved by a method of measuring a potential of the image bearing member and controlling a voltage to be applied to the charging member such that a desired potential can be obtained. However, the latter, that is, the charging unevenness due to fall of charging capability cannot be solved. This charging unevenness is caused because charging nonuniformity of image bearing property and a mechanical accuracy error of the charging member or the image bearing member and the like become conspicuous due to decrease of the charging capability of the charging member. This is most conspicuous in a cleanerless process in which a large amount of toner is mixed into the charging member.

In order to compensate for this disadvantage, the capability of the charging member must be increased by making a velocity difference between the image bearing member and the charging member sufficiently large and increasing the contact probability. Thus, in setting the velocity difference, it is necessary to set it a little larger considering contamination of the charging member in advance. On the other hand, since an amount of wear of the image bearing member and the velocity difference of the charging member are substantially proportionate, the longer the life of the charging member the larger the velocity difference becomes by itself, whereby the amount of wear of the image bearing member increases and the life of the image bearing member is shortened.

As a method of decreasing wear of a photosensitive member, which is an image bearing member, in the image forming apparatus of the contact charging method, Japanese Patent Application Laid-Open No. 9-96948 proposes changing a velocity difference of a charging member only when an image is not formed. However, it does not take wear during image formation into account.

SUMMARY OF THE INVENTION

The present invention has been devised in view of the above drawbacks, and it is an object of the present invention to provide an image forming apparatus that reduces wear of an image bearing member by a charging member.

It is another object of the present invention to provide an image forming apparatus that can realize an extended life of an image bearing member.

It is another object of the present invention to provide an image forming apparatus in which decrease of a charging performance of a charging member is prevented.

It is another object of the present invention to provide an image forming apparatus that can satisfactorily perform charging even if a charging member is contaminated.

It is yet another object of the present invention to provide an image forming apparatus in which a peripheral velocity difference is provided between a charging member and an image bearing member.

Other objects and characteristics of the present invention will be more apparent by reading the following detailed description with reference to accompanying drawings.

The accompanying drawings, which are incorporated in and constitute a part of the specification, illustrate embodiments of the invention and, together with the description, serve to explain the principles of the present invention.

DESCRIPTION OF THE PREFERRED EMBODIMENTS

Figure 1:
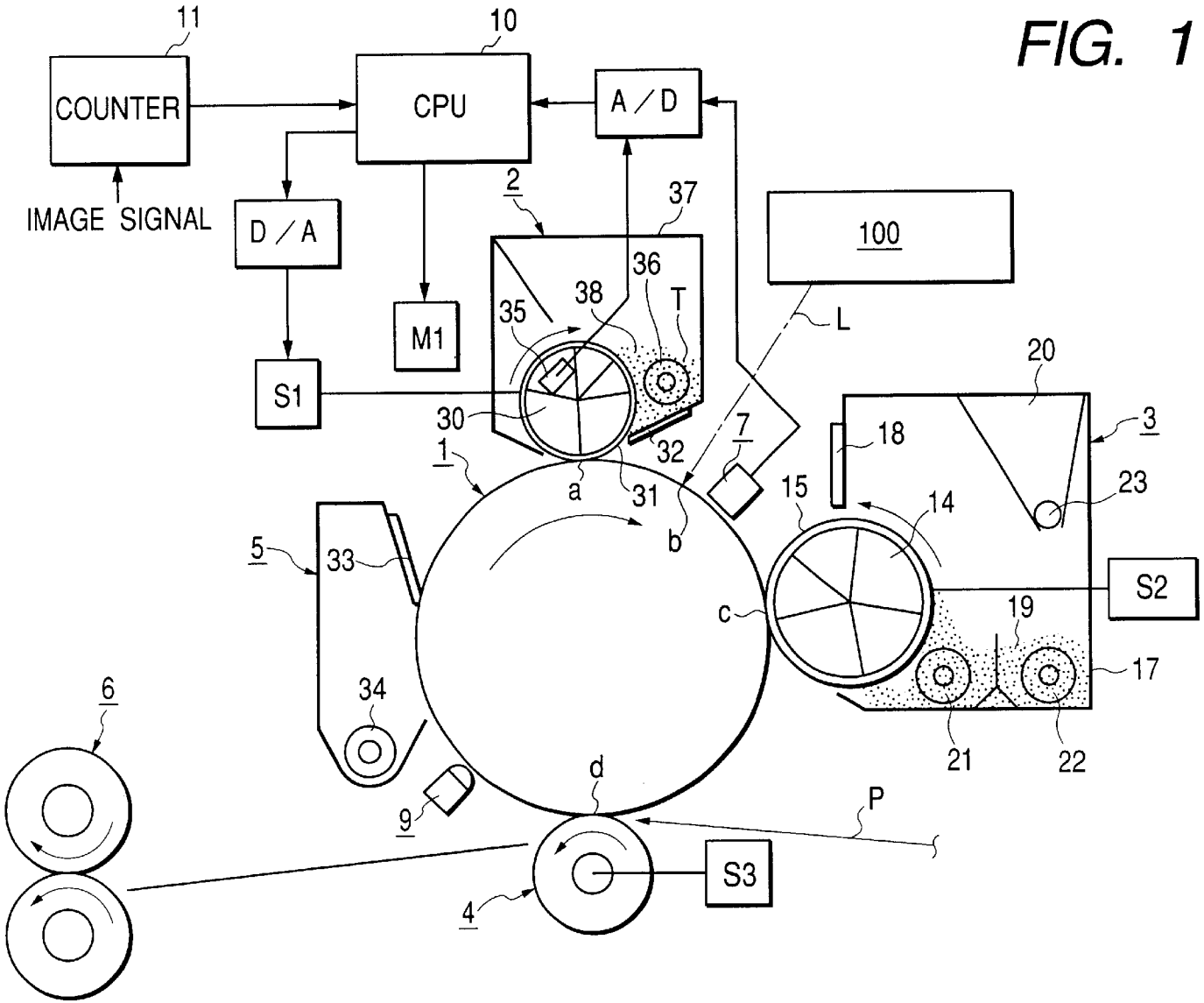
FIG. 1 is a schematic view showing a configuration of an image forming apparatus of a first embodiment.

First Embodiment (1) Overall Schematic Configuration of an Example of an Image Forming Apparatus FIG. 1 is a schematic view showing a configuration of an image forming apparatus in this embodiment.

The image forming apparatus of this embodiment is a laser beam printer of a transfer electrophotographic process, a magnetic brush contact charging method and a two-component/reversal development method.

Reference numeral 1 denotes an electrophotographic photosensitive member of a rotary drum type as an image bearing member (hereinafter referred to as photosensitive drum), which is rotationally driven clockwise shown by an arrow at a predetermined peripheral velocity.

Figure 2:
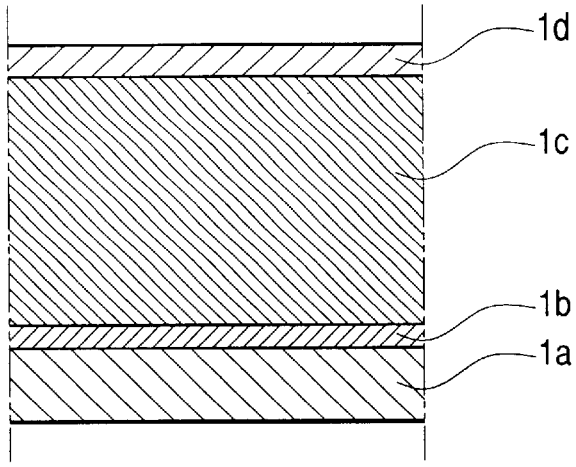
FIG. 2 is a schematic view showing a layer configuration of an amorphous silicon photosensitive drum.

The photosensitive drum 1 in this embodiment is an a-Si photosensitive member (amorphous silicon photosensitive member). FIG. 2 is a schematic view showing a cross section of this photosensitive drum, which consists of a conductive supporting body 1*a* that is an A1 cylinder of ϕ60 mm, a charge injection preventing layer 1*b*, a photoconductive layer 1*c*, and a surface layer 1*d* that are deposited to the surface of this conductive supporting body 1*a* one after another. The charge injection preventing layer 1*b* is for preventing injection of a charge from the conductive supporting body 1*a* to the photoconductive layer 1*c*. The photoconductive layer 1*c* is made of an amorphous material including silicon atoms as a main material and shows photoconductivity. Moreover, the surface layer 1*d* includes silicon atoms and carbon atoms and is responsible for retaining an electronic latent image to be formed on the surface and improving endurance of a film.

Reference numeral 2 denotes a magnetic brush contact electrifying apparatus (charger). The surface of the rotating photosensitive drum 1 is uniformly subjected to contact charging processing in predetermined polarity and potential in a charging portion a by this electrifying apparatus 2. In this embodiment, the surface of the rotating photosensitive drum 1 is charged in a predetermined negative potential. This magnetic brush contact electrifying apparatus 2 will be described in more detail in the Section (2).

Reference numeral 100 is a laser scanner as an image exposing apparatus that is latent image forming means. The laser scanner 100 emits a laser beam of the light emitting wavelength 680 nm, which is modulated in response to a time-series electric digital pixel signal (image signal) of image information, and scans and exposes L the uniformly charged processing surface of the rotating photosensitive drum 1 in an exposing portion b. A potential on the photosensitive drum 1 falls in a part where laser is irradiated and an electrostatic latent image (electronic latent image) is formed.

Reference numeral 3 denotes a developing apparatus, which is a two-component/reversal developing apparatus in this embodiment. The electrostatic latent image of the rotating photosensitive drum 1 is reversely developed as a toner image with negative toner in a developing portion c by this developing apparatus 3 (toner is adhered to an exposing light portion of the electrostatic latent image).

The developing apparatus 3 is provided with a rotating sleeve (developing sleeve) 15, which includes a fixed magnet roll 14. Developer 19 contained in a developing container 17 is coated on the sleeve 15 by a blade 18 in a thin layer and carried to the developing portion c.

The sleeve 15 is driven by a not-shown motor and is rotating at a peripheral velocity of 150 mm/sec counterclockwise as shown by an arrow.

The developer 19 is two-component developer, in which toner (negative toner) of a negative charging property with an average particle diameter of 8 $\mu$m and a magnetic carrier of a positive charging property with an average particle diameter of 50 $\mu$m are mixed at a weight toner density of 5%.

A toner density is controlled by a not-shown optical toner density sensor and toner in a toner hopper 20 is supplied by a supplying roller 23. The developer 19 in the developing container 17 is uniformly agitated by agitating members 21 and 22.

A developing bias, which is a direct current voltage Vde of −200 to −450 V determined by potential control superimposed on an alternating electric field of 2 kVpp and 2 kHz, is applied to the sleeve 15 from a bias power source S2.

The developer 19 that is coated in a thin layer and carried to the developing portion c develops the electronic latent image on the photosensitive drum 1 by an electric field formed by the above-mentioned AC+DC voltage.

Reference numeral 4 denotes a transfer roller, which contacts the photosensitive drum 1 to form a transfer nip portion d. In addition, a transfer bias of a positive polarity, which is a reversed polarity of the charging polarity of the toner, with a predetermined potential is applied from a bias power source S3. Then, a transfer material P is fed to the transfer nip portion d from a not-shown paper feeding mechanism portion at predetermined control timing and clamped in the transfer nip portion d to be conveyed, whereby toner images on the surface of the photosensitive drum 1 are electrostatically transferred to the surface of the transfer material P one after another.

Reference numeral 6 denotes a fixing apparatus in which the transfer material P separated from the surface of the photosensitive drum 1 is introduced through the transfer nip portion d and unfixed toner is thermally fixed on the transfer material P.

On the other hand, the surface of the rotating photosensitive drum 1 after the separation of the transfer material is subjected to irradiation of electricity removing exposure in an electricity removing exposure apparatus 9 and then subjected to scraping processing of transfer residual toner by a cleaning blade 33 of a cleaner 5 to be cleaned and repeatedly serve image formation. The transfer residual toner scraped off from the surface of the rotating photosensitive drum 1 is carried to a not-shown waste toner container by a screw 34 and collected.

Since an optical carrier generated by image exposure tends to affect the next charging potential to produce a history of images, so-called charging ghost as property of the a-Si photosensitive member 1, it is a general practice to take a measure to make the charging ghost less conspicuous by electricity removing exposure. The electricity removing exposure apparatus 9 has an emitted light wavelength of 660 nm and a light amount of 5 1·s (lux·s).

(2) Electrifying Apparatus 2

An electrifying apparatus 2 of this embodiment is a magnetic brush contact electrifying apparatus.

a) Schematic Configuration of the Electrifying Apparatus

Reference numeral 37 denotes an apparatus housing and 31 denotes a nonmagnetic sleeve (charging sleeve) that is a magnetic particle carrying member of ϕ16 mm, which is rotatably held in a bearing and disposed in the above-mentioned apparatus housing 37. The bottom surface of the sleeve 31 is exposed outside from the opening portion on the bottom surface side of the apparatus housing 37. Reference numeral 30 denotes a fixed (non-rotating) magnet roller enclosed in the sleeve 31. Reference numeral 32 denotes a blade for regulating a thickness of a magnetic brush layer, 38 denotes magnetic particles contained in the apparatus housing 37 in an appropriate amount and 36 denotes a screw for agitating magnetic particles disposed in the apparatus housing 37 to be associated with a pooling portion T of the contained magnetic particles 38.

The above-mentioned electrifying apparatus 2 is disposed with the sleeve 31 made to oppose the surface of the photosensitive drum 1 with an interval of 500 μm between them. The sleeve 31 is rotationally driven clockwise as shown by an arrow by a motor M1. The magnet roller 30 is formed in a repulsion pole configuration having five magnetic pole peaks in the rotating direction of the sleeve 31 and having magnetic pole peaks of the same polarity adjacent them.

There is the pooling portion T of the magnetic particles 38 on the upstream side in the rotating direction of the sleeve of the blade 32. The screw 36 rotates in response to the rotation of the sleeve 31 and agitates the magnetic particles 38 in the pooling portion T in a sleeve bus direction. The screw 36 has elliptic blades attached to it in alternating directions and can agitate the magnetic particles 38 in the pooling portion T without causing them to lean to one side.

A part of the magnetic particles 38 in the pooling portion T is held by a magnetic binding force generated by a magnetic force of the magnet roller 30 as a magnetic brush layer in the sleeve on the external surface of the sleeve 31.

The magnetic brush layer is carried as the sleeve 31 rotates and passes through the gap between the sleeve 31 and the blade 32, thereby being carried out of the apparatus housing 37 with its layer thickness regulated to a predetermined thickness. The thickness of the magnetic brush layer to be regulated by the blade 32 is set larger than the interval 500 μm between the sleeve 31 and the photosensitive drum 1 by a predetermined amount. Therefore, the magnetic brush layer carried out of the apparatus housing 37 contacts the surface of the photosensitive drum 1 with a predetermined width in the opposing parts of the sleeve 31 and the photosensitive drum 1 to rub the surface of the photosensitive drum 1. The contacted and rubbed portion is the charging portion a. The magnetic brush layer having passed the charging portion a following the subsequent rotation of the sleeve 31 is carried back into the apparatus housing 37 and returns to the magnetic particle pooling portion T again. This cycle is repeated.

In the charging portion a, since the moving direction of the magnetic brush layer following the rotation of the sleeve 31 is opposite the moving direction of the surface of the photosensitive drum 1, the magnetic brush layer and the surface of the photosensitive drum contact with each other with a velocity difference.

In addition, a charging bias that is a direct current voltage Vch of −600 to −800 V, which is determined through a potential control process, superimposed on an alternating electric field of 500 Vpp, 1 kHz can be applied to the sleeve 31 from the bias power source S1.

Thus, the surface of the photosensitive drum 1 is uniformly subjected to contact injection charging processing to have a potential substantially equal to the direct current voltage Vch.

In the above description, the assembly of the charging sleeve 31, the magnet roller 30 and the magnetic brush layer of the magnetic particles 38 are a magnetic brush charging member and the magnetic particles of the magnetic brush layer form a contacting member.

The sleeve 31 is rotationally driven at a predetermined control velocity clockwise as shown by an arrow by the motor M1 as described above. In this embodiment, it is rotationally driven at a peripheral velocity of an initial value 50 mm/sec. The peripheral velocity of the sleeve 31 is variable according to an integrated value of image densities as described later. The bearing portion of the sleeve 31 is provided with an optical number-of-rotations detecting apparatus 35 and the sleeve 31 is controlled to rotate at a desired peripheral velocity.

If the peripheral velocity of the sleeve 31 is too low, the contacting probability of the surface of the photosensitive drum and the magnetic particles 38 of the magnetic brush layer becomes insufficient, which contributes to an image defect such as charging unevenness. If it is too high, scattering of the magnetic particles 38 is caused. Although a peripheral velocity for allowing satisfactory charging depends on the external diameter of the sleeve 31 or the interval between the sleeve 31 and the photosensitive drum 1, the peripheral velocity of the charging sleeve 31 in this embodiment is preferably 50 to 250 mm/sec. The gap between the photosensitive drum 1 and the sleeve 31 in the charging portion a (charging nip) is 500 μm and a magnetic flux density by the magnet roller 30 on the sleeve 31 of the charging portion a is $950\times10^{-4}$ T.

b) Magnetic Particles 38

The following and other materials are preferably used as the magnetic particles 38.

(1) Resin and magnetic powder such as magnetite mulled and cast into particles or those with conductive carbon or the like mixed for adjusting a resistance value (2) Sintered magnetite and ferrite or those subjected to reduction or oxidation processing to adjust a resistance value (3) The above-mentioned magnetic particles coated with a resistance-adjusted coating material (phenol resin with carbon scattered or the like) or subjected to plating processing with a metal such as Ni to adjust a resistance value to be an appropriate value As to a resistance value of these magnetic particles, if it is too high, a charge cannot be uniformly injected on the photosensitive drum 1 and a fogged image is produced due to a very small charging defect. If it is too low, when there is a pin hole on a surface of a photosensitive drum, currents are concentrated in the pin hole to drop a charging voltage and the surface of the photosensitive drum cannot be charged, whereby a charging defect like a charging nip is caused. Thus, as the resistance value of the magnetic particles, $1\times10^4$ to $1\times10^7\Omega$ is desirable.

As magnetic property of the magnetic particles, a magnetic binding force is preferably high in order to prevent adhesion of the magnetic particles on the photosensitive drum 1 and saturation magnetization is desirably 50 ($A\cdot mm^2/kg$) or more.

Actually, the magnetic particles 38 used in this embodiment have the following property.

Volume average particle diameter 30 $\mu$m

Apparent density 2.0 (g/cm$^3$)

Resistance value $1\times10^6$ $\Omega$

Saturation Magnetization 58 (A·mm$^2$/kg)

In addition, the particle diameter of the magnetic particles affects charging capability and uniformity of charging. That is, if the particle diameter is too large, a ratio of contact with the photosensitive drum 1 falls, which becomes a cause of charging unevenness. If the particle diameter is too small, both the charging capability and the uniformity are improved but, on the other hand, a magnetic force acting on one particle falls, whereby adhesion on the photosensitive drum 1 is easily caused. Thus, the magnetic particles with the particle diameter of 5 to 100 $\mu$m are preferably used.

The gross weight of the magnetic particles is 200 g. The magnetic particles 38 in the pooling portion T are configured such that the entirety of the magnetic particles are gently agitated by an agitating effect generated by repulsion poles of the screw 36 and the magnet roller 30.

c) Control of a Charging Voltage and a Developing Voltage

In this embodiment, a potential sensor 7 for measuring a potential on the surface of the photosensitive drum 1 after charging by the electrifying apparatus 2 is provided. A charging voltage Vch to be applied to the charging sleeve 31 of the electrifying apparatus 2 and a developing voltage Vde to be applied to the developing sleeve 15 of the developing apparatus 3 are controlled by a CPU 10, which is controlling means, based on a potential measured by the potential sensor 7.

In this embodiment, initial potential control is performed upon inputting a power source of the image forming apparatus to set a charging potential and a developing potential. When an image is formed, potential correction is performed to correct a potential variation due to a change in a temperature of the apparatus during stand-by.

A process of the initial potential control will be described. This initial potential control is described in paragraph 0028 and FIG. 4 of Japanese Patent Application Laid-Open No. 5-100535. In this case, V1 is VG1, Vh is VG2, potentials in case of exposure at $L_{00}$ are VD1 and VD2, and potentials in case of exposure at $L_{FF}$ are VL1 and VL2. First, charging voltages are set at predetermined Vh and V1 and image exposures $L_{00}$ and $L_{FF}$ are performed at each charging voltage to measure a potential of a photosensitive member. An $L_{00}$ curve and an $L_{FF}$ curve of the potential of the photosensitive member with respect to the charging voltages are found based on the values. A curve found by subtracting a predetermined constant from the $L_{00}$ curve is assumed to be an $L_{cont}$ curve. A charging voltage value and a developing direct current voltage value are calculated from the difference between the $L_{cont}$ curve and the $L_{FF}$ curve so as to obtain a proper contrast potential.

In the potential correction, a potential of a photosensitive member at the time of potential control and a potential of a photosensitive member at the time when an image formation start command is received are compared to find a difference. A charging voltage is corrected based on the difference.

(3) Peripheral Velocity Control of the Charging Sleeve 31

Figure 3:
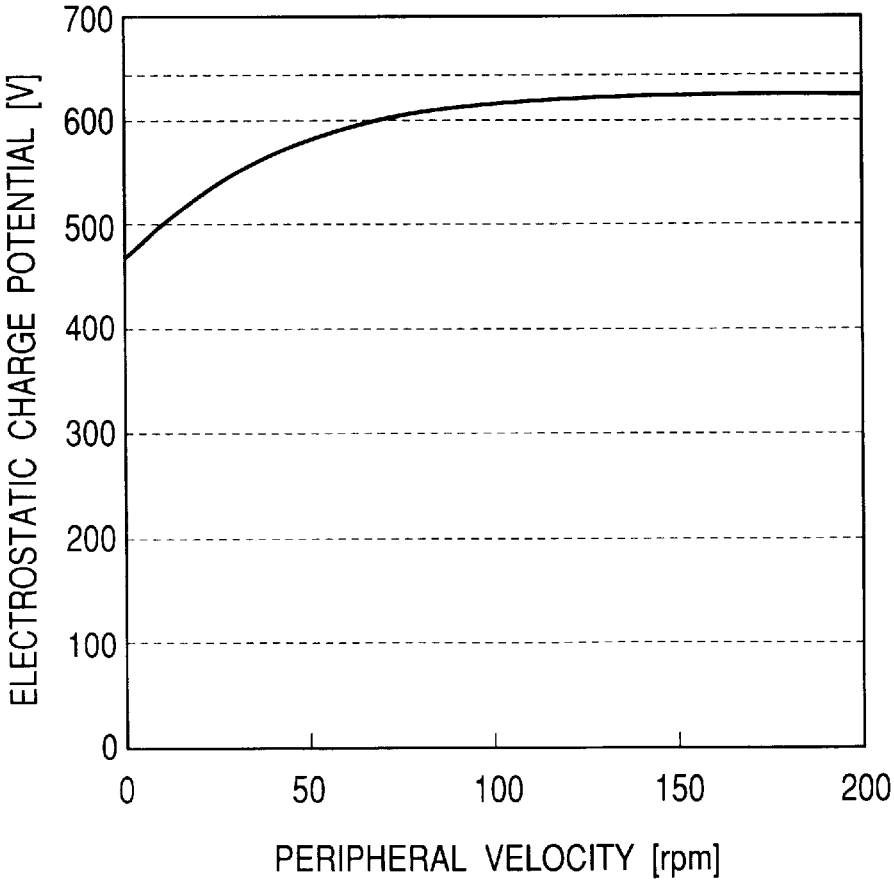
FIG. 3 is a graph representing a relation between the number of rotations of a charging sleeve and a surface potential of a photosensitive drum.

A relation in an initial state between a peripheral velocity of the sleeve 31 of the electrifying apparatus 2 and a potential of the photosensitive drum 1 in the image forming apparatus of this embodiment is shown in FIG. 3. Since a velocity difference between the sleeve 31 and the photosensitive drum 1 increases and the contact probability of the magnetic particles of the magnetic brush layer and the surface of the photosensitive drum increases along with the increase of the number of rotations per unit time of the sleeve 31, the potential of the photosensitive drum 1 rises.

A tendency of the potential of the photosensitive drum 1 to saturate is observed. This is because, as a sleeve peripheral velocity increases, a slippage of magnetic particles on a sleeve becomes large and a velocity of the magnetic particles on the photosensitive drum 1 saturates.

In this embodiment, a sufficient charging uniformity was obtained with the peripheral velocity 50 mm/sec of the sleeve 31 in the electrifying apparatus 2 in the initial state.

In FIG. 1, an image signal for each image formation is supplied to a counter 11, which is sequentially integrated as a video count. A result of the integration is supplied to the CPU 10 and compared with a table of integrated values and the numbers of rotations of the charging sleeve 31 stored in advance. The charging sleeve 31 is controlled and driven according to the number of rotations based on a result of the comparison. That is, when charging for image formation is performed with respect to a photosensitive member, the peripheral velocity of the charging sleeve 31 is controlled based on the above-mentioned integrated value. The rotating peripheral velocity of the charging sleeve 31 is controlled by the number of rotation detecting apparatus 35 of the sleeve 31 and a DC bias applied to the motor M1.

In this embodiment, a method of dividing an integrated value of the video count into five areas I, II, III, IV and V and controlling a sleeve peripheral velocity at 50, 80, 120, 170 and 230 mm/sec for each area was employed.

In an electrophotographic apparatus of the contact charging method provided with the cleaner 5 as in the image forming apparatus of this embodiment, a charging preventing factor mixing into the charging member (magnetic brush layer) of the electrifying apparatus 2 is externally added agent of toner in most cases. This is because the externally added agent has a very small particle diameter and easily avoids the cleaning blade 33 although particles with relatively large diameters such as toner and paper powder are scraped off by the cleaning blade 33.

In this case, since the externally added agent is once stopped by the cleaning blade 33 and then gradually avoids it, the externally added agent is mixed into the charging member of the electrifying apparatus 2 in a relatively scattered form even if images on which transfer residual toner is concentrated in a small area in the bus direction of the photosensitive drum are continuously outputted. Therefore, the charging capability is less likely to decrease locally in the bus direction of the charging member.

Since the externally added agent has a small particle diameter, it rarely separates from magnetic particles if it adheres to them once. In addition, since the transfer residual toner is not mixed into it, the charging capability does not suddenly change according to a ratio of images and decrease of the charging capability progresses very slowly.

Therefore, in the electrophotographic apparatus of the contact discharge method provided with the cleaner 5, a value found by integrating signals on an entire image and the charging capability associate with each other satisfactorily and a favorable image with less unevenness in the bus direction of the photosensitive drum can be obtained by controlling a rotating peripheral velocity of the sleeve 31, that is, a velocity difference of the photosensitive drum and the charging member based on the value.

The table of integrated values of the video count and the numbers of rotations of the sleeve 31 is prepared by the following procedure.

The number of rotations (peripheral velocity) Rmax of the charging sleeve 31 is determined with which sufficient charging uniformity can be obtained in the electrifying apparatus 2 after performing a continuous endurance test at the ratio of images of 8% using 100 k pieces of A4 horizontal paper which is the durable life of the electrifying apparatus 2.

In addition, a charging potential Ve in a central value of the control of the charging potential Vch at that point is also measured.

On the other hand, a charging bias of the central value of the control is applied to the electrifying apparatus in the initial state to determine the number of rotations Rmin of the sleeve 31 with which sufficient charging uniformity is obtained and a potential substantially equal to the charging potential Ve is obtained.

In addition, a potential Vs in the case where the sleeve 31 rotates at the number of rotations Rmax is measured.

Here, the number of areas of the control is determined taking a difference between the potential Vs and the potential Ve into account and is denoted by N.

Next, the number of rotations is set such that, in the case where a value found by dividing the difference between the potential Vs and the potential Ve by the number of areas N is denoted by Vt and the number of rotations Rmin of the sleeve 31 and the applied bias of the electrifying apparatus are fixed at the central value of the control, the potential becomes approximately Ve at the time when the potential drop in the continuous endurance at the ratio of images 8% reaches the value Vt.

In this way, the number of rotations of the charging sleeve 31 in each area is set.

Then, the video count at the point when the area is switched is extracted to prepare a table of video counts and the numbers of rotations of the charging sleeve 31.

An actual video count may be larger than an estimated value depending on a situation in which the apparatus is used. In such a case, control is continuously performed with the set maximum number of rotations.

Figure 4:
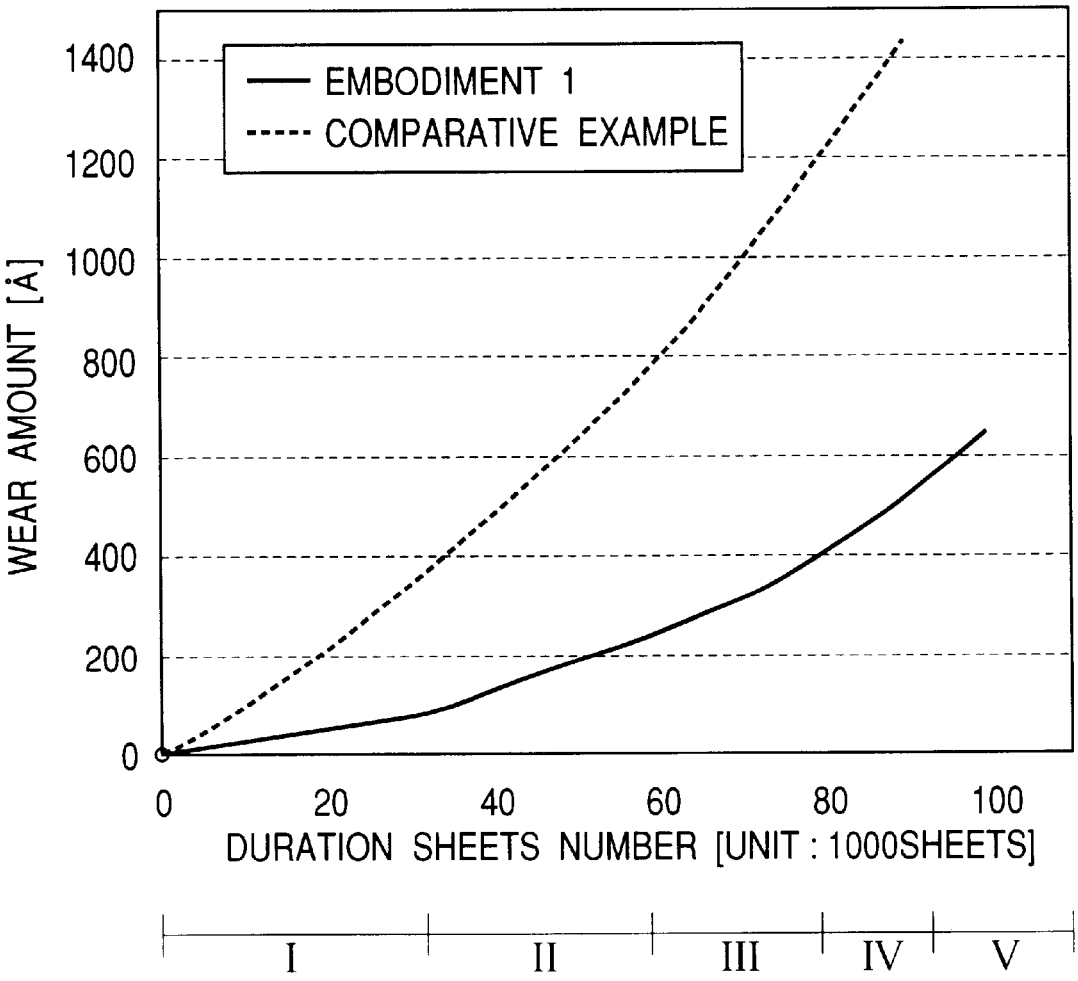
FIG. 4 is a graph representing changes in an amount of wear of a photosensitive drum and a designated range of the number of rotations of a charging sleeve when an endurance test is performed in the image forming apparatus of the first embodiment.

FIG. 4 shows a relation between the number of durable number of pieces and a worn amount of the photosensitive drum in the endurance test at an arbitrary ratio of images using the number or rotation control of the charging sleeve 31 in this embodiment.

FIG. 4 also shows a result of an endurance test with the number of rotations of the charging sleeve 31 fixed at Rmax from an initial stage as a comparative example.

A worn amount of a photosensitive member is considerably reduced by performing the control shown in this embodiment.

The controlling method of this embodiment is only an example and, for example, the number of areas of control can be increased or decreased according to a durable life of an electrifying apparatus and other properties. In addition, it is also possible to perform continuous control without setting an area.

As described above, the number of rotations of the charging sleeve 31 is made variable according to the charging capability of the electrifying apparatus 2, whereby the charging sleeve 31 is not rotated at the number of rotations exceeding the required number. Thus, it became possible to eliminate unnecessary wearing of the photosensitive drum 1 and the life of the photosensitive member was successfully extended.

Second Embodiment

Figure 5:
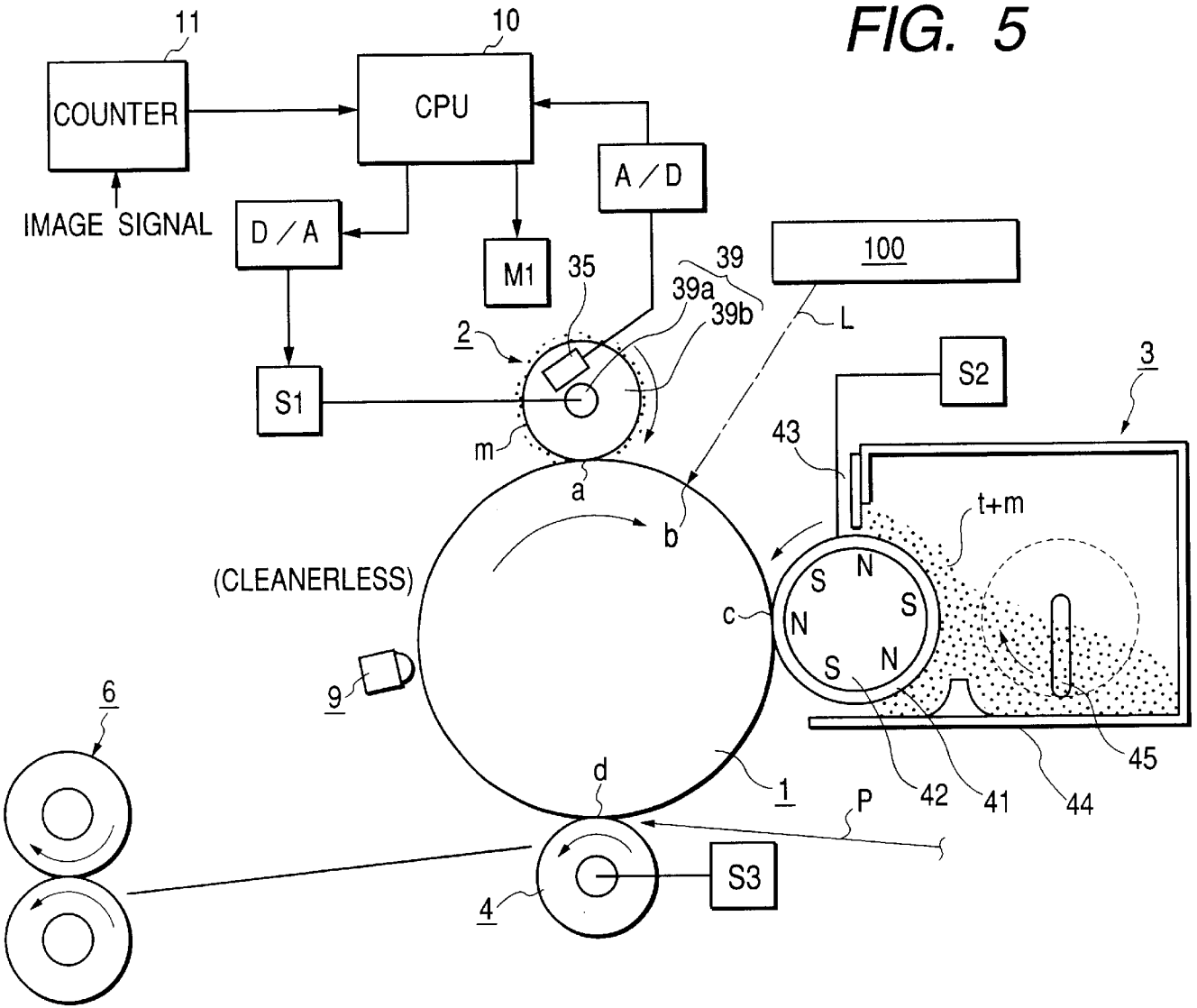
FIG. 5 is a schematic view showing a configuration of an image forming apparatus (cleanerless) of a second embodiment.

FIG. 5 is a schematic view showing a configuration of an image forming apparatus in this embodiment.

This image forming apparatus is cleanerless. In this image forming apparatus, the cleaner 5 is deleted from the image forming apparatus of the first embodiment. In addition, the electrifying apparatus 2 is changed from the magnetic brush contact electrifying apparatus to a contact injection electrifying apparatus using nonmagnetic conductive particulates (charging particles, charging accelerating particles) disclosed in U.S. Pat. Nos. 6,081,681, 6,128,456 and 6,134,407, Japanese Patent Application Laid-Open No. 10-307458 and the like, and the developing apparatus 3 is changed from the two-component reversal developing apparatus to a magnetic one-component reversal developing apparatus. The members and portions common to the image forming apparatus of this embodiment and the first embodiment are denoted by the same reference symbols and their repeated descriptions are omitted.

With the cleanerless method in this embodiment, nonmagnetic conductive particulates (hereinafter referred to as conductive fine particulate matters) m are added to magnetic toner t that is developer in a developing container 44 in the magnetic one-component reversal developing apparatus 3, the same conductive fine particulate matters m are adhered to a charging assistance agent on the external circumference surface of a conductive elastic roller (hereinafter referred to as charging roller) 39 that is a contact charging member of the electrifying apparatus 2 in advance, and the conductive fine particulate matters are carried to a photosensitive member together with transfer residual toner to be adhered to and mixed on the charging roller 39, whereby a stable cleanerless system is established.

The charging roller 39 is caused to contact the surface of the photosensitive drum 1 by a predetermined pressing force and rotationally driven clockwise as shown by an arrow by the motor M1, thereby contacting the surface of the rotating photosensitive drum 1 via the conductive fine particulate matters m with a velocity difference. In addition, a predetermined charging bias is applied to the charging roller 39 from the bias power source S1 to uniformly apply contact injection charging to the surface of the photosensitive drum 1.

Behaviors of the toner particles and the conductive fine particulate matters in an image forming process will be described more in detail.

The conductive fine particulate matters m included in the toner t of the developing apparatus 3 move to the photosensitive drum surface in an appropriate amount together with toner base particles at the time when an electrostatic latent image on the photosensitive drum 1 is developed in the developing process.

A toner image on the photosensitive drum 1 moves to the transfer material P side in a transfer process. Although a part of the conductive fine particulate matters on the photosensitive drum 1 is also adhered to the transfer material, the remainder of the conductive fine particulate matters is adhered to and held on the photosensitive drum 1 and remains there. If transfer is performed by applying a transfer bias of a polarity opposite that of the toner t, although the toner t is attracted and actively moves to the transfer material P, the conductive fine particulate matters m on the photosensitive drum 1 do not actively move to the transfer material P because they are conductive. A part of them is adhered to the transfer material P but the remainder is adhered to and held on the photosensitive drum 1 and remains there.

In an image forming method that does not use the cleaner 5, transfer residual toner remaining on the surface of the photosensitive drum 1 after transfer and the above-mentioned remaining conductive fine particulate matters are carried as they are to the charging portion a, which is a portion where the photosensitive drum 1 and the charging roller 39 being the contact charging member abut with each other, with the movement of the surface of the photosensitive drum 1 and are adhered to and mixed on the charging roller 39.

Therefore, the contact charging of the photosensitive drum 1 is performed in a state in which the conductive fine particulate matters m intervene in the charging portion a that is the abutting portion (nip portion) of the photosensitive drum 1 and the charging roller 39.

Accurate contacting property of the charging roller 39 to the photosensitive drum 1 and a contact resistance can be maintained due to the existence of this conductive fine particulate matters m regardless of contamination by adhesion and mixture of the transfer residual toner on the charging roller 39. Thus, charging of the photosensitive drum 1 by the charging roller 39 can be performed satisfactorily.

In addition, the transfer residual toner adhered to and mixed on the charging roller 39 is charged in the same polarity as a charging bias applied to the photosensitive drum 1 from the charging roller 39 by the charging bias and gradually discharged onto the photosensitive drum 1 from the charging roller 39. Then, the transfer residual toner reaches the developing portion c along the movement of the surface of the photosensitive drum 1 and is subjected to the cleaning simultaneous with development (collected) in the developing process by the developing apparatus 3.

Moreover, since the image formation is repeated, the conductive fine particulate matters m included in the toner t in the developing apparatus 3 move to the surface of the photosensitive drum 1 in the developing portion c and are carried to the charging portion a through the transfer portion d by the movement of the surface of the photosensitive drum to be continuously supplied to the charging portion a in a sequential manner. Thus, even if the conductive fine particulate matters m are decreased by falling down or the like in the charging portion a or deteriorated, a decrease of charging property is prevented from occurring and favorable charging property is steadily maintained. matters m are decreased by falling down or the like in the charging portion a or deteriorated, decrease of charging property is prevented from occurring and favorable charging property is steadily maintained.

However, in such a case where outputs of a high ratio of images continue, the conductive fine particulate matters m may be insufficient compared with the toner amount to cause a charging defect.

The charging process in the apparatus of this embodiment employs a contact electrifying apparatus for causing the conductive charging roller 39 of a roller type as a charging member to contact the photosensitive drum 1 and applying a predetermined charging bias to this charging roller 39 to charge the surface of the photosensitive drum 1 in predetermined polarity and potential. Although it is possible to obtain favorable charging property only with a direct current voltage as the charging bias applied to the charging roller 39, an alternating voltage (alternating current voltage) may be superimposed on a direct current voltage. As a waveform of the alternating voltage, a sine wave, a rectangular wave, a triangle wave and the like can be appropriately used. In addition, it may be a pulse wave formed by periodically turning on/off a direct current power source. In this way, a bias with its voltage value changing periodically can be used as the waveform of the alternating voltage. A direct current voltage of −700 V is applied to a feeding portion of the charging roller 39 from the power source S1 in this embodiment.

The charging member preferably has elasticity in providing an abutting portion for intervening conductive fine particulate matters between the charging member and a photosensitive drum and is preferably conductive in order to charge the photosensitive drum 1 by applying a voltage. Therefore, the charging member is preferably and favorably a brush that has a magnetic brush portion in which a conductive elastic roller and magnetic particles are magnetically bound and is formed of a magnetic brush contact charging member or a conductive fiber having the magnetic brush portion contacted to the photosensitive drum. In this embodiment, the conductive elastic roller is used.

If hardness of the charging roller 39 that is the conductive elastic roller is too low, contacting property of the charging roller 39 with the photosensitive drum 1 is deteriorated because its shape is unstable. Moreover, since the conductive fine particulate matters m are caused to intervene in the charging portion a that is the abutting portion of the charging roller 39 and the photosensitive drum 1, the surface layer of the charging roller is worn or damaged and stable charging property cannot be obtained. In addition, if the hardness is too high, since the charging abutting portion cannot be secured between the charging roller 39 and the photosensitive drum 1 and, in addition, micro-contacting property to the surface of the photosensitive drum is worsened, a preferable range is 25 degrees to 50 degrees in the Asker C hardness.

It is important for the charging roller 39 to be given elasticity to obtain a sufficient contact state with the photosensitive drum 1 and, at the same time, to function as an electrode having a sufficiently low resistance for charging the moving photosensitive drum 1. On the other hand, it is necessary to prevent leakage of a voltage if a defective part such as a pin hole exists in the photosensitive drum 1. If an electrophotographic photosensitive member is used, it is favorable to have a resistance of $10^3$ to $10^8\Omega$ in order to obtain sufficient charging property and leak tolerance and it is more preferable to have a resistance of $10^4$ to $10^7\Omega$. The charging roller resistance was measured by applying 100 V between a core metal and an aluminum drum in a state in which a charging roller is compression-bonded to a cylindrical aluminum drum of $\phi$30 mm such that a total pressure of 9.8 N (1 kg) is applied to the core metal of the roller.

For example, the charging roller 39 is produced by forming a middle resistance layer **39*b* of rubber or an elastic foam material as a flexible member on a core metal 39*a***.

The middle resistance layer **39*b* is made of resin (e.g., urethane), conductive particles (e.g., carbon black), sulfidizing agent, foaming agent or the like and formed in a roller shape on the core metal 39*a*. Thereafter, the middle resistance layer 39*b* is cut or the shape of it is arranged by grinding, if necessary, whereby the charging roller 39** that is the conductive elastic roller can be produced. It is preferable that the roller surface has fine cells or unevenness in order to cause the conductive fine particulate matters m to intervene. The roughness of the roller surface is desirably larger than the roughness of the photosensitive member surface.

The material of the charging roller 39 is not limited to elastic foam. As materials of an elastic body, there are given rubber materials with conductive substances such as carbon black and metal oxide dispersed in ethylene-propylene-dienpolyethylene (EPDM), urethane, butadienacrylonitrile rubber (NBR), silicone rubber, isoprene rubber and the like for adjusting a resistance or a foamed version of these rubber materials. In addition, it is also possible to adjust a resistance using an ion conductive material without dispersing the conductive substances or together with the conductive substances.

In this embodiment, the conductive elastic roller made of foamed urethane on which carbon black was dispersed was used. More specifically, an SUS roller of ϕ6 was used as the core metal 39*a,* on which a foamed urethane layer of a middle resistance that was made of urethane resin, carbon black as conductive particles, sulfidizing agent, foaming agent or the like was formed in a roller shape. Then, the shape and surface property of the foamed urethane layer were arranged by cutting and grinding it to have the conductive elastic roller of ϕ12 as a flexible member, which was used in this embodiment. The obtained charging roller 39 had a resistance of $10^5$ Ω·cm and a hardness of 30 degrees in the Asker C hardness.

The charging roller 39 is disposed so as to be in pressured contact with the photosensitive drum 1 with a predetermined pressing force against its elasticity and the charging portion a that is the abutting portion of the charging roller 39 and the photosensitive drum 1 is formed. Although the width of this charging portion is not specifically limited, it is desirably 1 mm or more and, more preferably, 2 mm or more in order to have stable and close contacting property of the charging roller 39 and the photosensitive drum 1. In this embodiment, the width was 1.4 mm.

In addition, as the charging roller 39 has flexibility, a chance of the conductive fine particulate matters m contacting the photosensitive drum 1 is increased in the abutting portion of the charging roller 39 and the photosensitive drum 1 and high contacting property can be realized, which is preferable and favorable in increasing the contact injection charging property (direct injection charging property). That is, the charging roller 39 contacts the photosensitive drum 1 closely via the conductive fine particulate matters m and the conductive fine particulate matters m existing in the abutting portion of the charging roller 39 and the photosensitive drum 1 rub the surface of the photosensitive drum 1 evenly, whereby charging of the photosensitive drum 1 by the charging roller 39 is predominantly the stable and safe contact injection charging without using the discharge phenomenon by the existence of the conductive fine particulate matters m. In addition, high charging efficiency that has not been realized with the conventional roller charger or the like can be realized and a potential substantially equivalent to a voltage applied to the charging roller 39 can be given to the photosensitive drum 1.

Moreover, since a relative velocity difference is provided between moving velocities of the surface of the charging roller 39 and the surface of the photosensitive drum 1, which form the abutting portion, chance of the conductive fine particulate matters m contacting the photosensitive drum 1 in the abutting portion of the charging roller 39 and the photosensitive drum 1 is remarkably increased and higher contacting property can be realized. This is preferable and favorable in increasing the contact injection charging property.

Since the conductive fine particulate matters m are caused to intervene in the abutting portion of the charging roller 39 and the photosensitive drum 1, it becomes possible to provide a velocity difference without involving a significant increase of torque between the charging roller 39 and the photosensitive drum 1, a conspicuous wear of the surfaces of the charging roller 39 and the photosensitive drum 1, and the like by a smoothing effect (lubricating effect or friction reducing effect) of the conductive fine particulate matters m.

However, even if the conductive fine particulate matters m intervene in the abutting portion, wear is not completely eliminated but increases in proportion to the velocity difference. That is, as in the first embodiment in which conductive magnetic particles are used as a conductive member, when the velocity difference is made larger in order to increase the charging capability, the amount of wear also increases.

As a configuration for providing a velocity difference between the photosensitive drum 1 and the charging roller 39, the motor M1 for driving the charging roller 39 is variably controlled to rotate.

In the case of the cleanerless configuration, in order to temporarily collect transfer residual toner on the photosensitive drum 1 carried to the charging portion a in the charging roller 39 and level the transfer residual toner, it is preferable and favorable to cause the charging roller 39 and the photosensitive drum 1 to move in opposite directions in the charging portion a. For example, it is desirable to rotatably drive the charging roller 39 and to make its rotating direction be opposite to the moving direction of the surface of the photosensitive drum 1. That is, it is possible to advantageously perform contact injection charging by rotating the charging roller 39 in the reverse direction to temporarily remove the transfer residual toner on the photosensitive drum 1 and charge the photosensitive drum 1.

It is also possible to move the charging roller 39 in the same direction as the moving direction of the surface of the photosensitive drum 1 to give them a velocity difference. However, since the charging property of the contact injection charging depends on a ratio of the peripheral velocity of the photosensitive drum 1 and the peripheral velocity of the charging roller 39, the number of rotations becomes larger in the case of the forward direction than in the case of the reverse direction in order to obtain the same peripheral velocity ratio as in rotation of the reverse direction. Thus, it is advantageous to move the charging roller 39 in the reverse direction in terms of the number of rotations.

The peripheral velocity ratio described here is as follows.

Peripheral velocity ratio (%)=Peripheral velocity of charging roller/Peripheral velocity of photosensitive drum×100

(A peripheral velocity of a charging roller is a positive value at the time when the surface of the charging roller moves in the same direction as the surface of a photosensitive drum.) In this embodiment, the charging roller 39 is rotated at the peripheral velocity ratio of −60% with respect to the moving velocity of the surface of the photosensitive drum.

In addition, the optical number of rotation detecting apparatus 35 is provided on the rotary shaft of the charging roller 39. The motor M1 is controlled based on a result of detection by the number of rotation detecting apparatus 35 and the charging roller 39 is driven at desired number of rotations and peripheral velocity.

Further, an amorphous silicon photosensitive member is used for the photosensitive drum 1 as in the first embodiment, which is rotating at the peripheral velocity of 130 mm/sec in the direction of an arrow.

It is preferable to use an elastic conductive roller, which is a flexible member, or a rotatable charging brush roller as the contact charging member 39 for temporarily collecting the transfer residual toner on the photosensitive drum 1 and, at the same time, carrying the conductive fine particulate matters m to advantageously execute the contact injection charging.

If the amount of intervention of the conductive fine particulate matters m in the abutting portion of the photosensitive drum 1 and the charging roller 39 is too small, the smoothing effect by the conductive fine particulate matters m is insufficiently obtained and the friction between the photosensitive drum 1 and the charging roller 39 is large. Thus, it is difficult to rotatably drive the charging roller 39 with a velocity difference between the charging roller 39 and the photosensitive drum 1. That is, the driving torque becomes excessively large and, if the charging roller 39 is forced to rotate, the surfaces of the charging roller 39 and the photosensitive drum 1 are worn. Moreover, since the effect of increasing chances of contact by the conductive fine particulate matters m is not obtained, sufficient charging property is not realized. On the other hand, if the amount of intervention is too large, the amount of the conductive fine particulate matters m dropping from the charging roller 39 increases remarkably, which adversely affects image formation.

The developing apparatus 3 is a magnetic one-component developing apparatus. Reference numeral 41 denotes a developing sleeve using a nonmagnetic member, which is installed rotatably counterclockwise as shown by an arrow in the figure. Reference numeral 42 denotes a permanent magnet fixed inside the sleeve 41, 43 denotes a magnetic blade using a magnetic member, 44 denotes a developing container and 45 denotes a carrying member. The magnetic blade 43 is arranged such that the distance between the magnetic blade 43 and the developing sleeve 41 is a fixed value W. In general, the distance W is preferably set at a value within a range of 100 $\mu$m to 1 mm. It was 350 $\mu$m in this embodiment.

The toner t is black toner with an average particle diameter of 10 $\mu$m in which magnetite, carbon black or the like is dispersed, 2 parts by weight of conductive fine particulate matters m is externally added to it.

As the conductive fine particulate matters m, zinc oxide particles with an average particle diameter of 1.5 $\mu$m were used.

There can be given the following characteristics in a tendency of change in the charging capability of the charging member (charging roller) 39 in the cleanerless system.

(1) Since transfer residual toner is mixed on the charging roller 39, the charging capability steeply changes according to a ratio of images to be output.

(2) Toner adhered to the charging roller 39 drops from the charging roller 39 at a substantially fixed ratio with respect to the adhered toner amount and is collected in the developing container 44. Thus, the charging capability of the charging roller 39 does not simply decrease but increases or decreases according to a ratio of images to be outputted.

(3) Since it is less likely that transfer residual toner spreads in the bus direction of the photosensitive drum, a local charging defect is easily caused depending on an image pattern to be outputted.

Due to such characteristics, even if control is performed based on a value found by simply integrating video counts of the first embodiment, a charging defect is easily caused.

Therefore, in this embodiment, integration of video counts is performed by a method described below and control is performed based on the integrated value.

Video counts are integrated for each pixel in the sub-scanning direction. The integration is performed only for outputted images in the past ten outputs. The method of integration is assumed to be as follows.

$$Sn=p^{10}\times D_{10}+p^{9}\times D_{9}+\ldots+p^{2}\times D_{2}+p\times D_{1}$$

Here, Sn is a calculated value found from an integrated value of video counts in the outputted image in the past ten outputs, which is the n-th calculated value in the sub-scanning direction. P is a coefficient equal to or smaller than 1, which relates to easiness of toner dropping from the charging roller 39. It is 0.75 in this embodiment. Dm is an integrated value of pixels in the sub-scanning direction of outputted images in the past m times of outputs. Further, the coefficient p and the integrated number of times of image outputs are not limited to the above and can be properly altered to be adapted to property of an image output apparatus. In addition, other than integrating respective pixels in the sub-scanning direction, the sub-scanning direction may be divided into several areas to use an integrated value for each area.

In this way, a maximum value Sn max is extracted out of the obtained Sn for pixels in each sub-scanning direction. Five areas are provided for the value of Sn max and a corresponding peripheral velocity of the charging roller 39 is set for each area. Then, the charging roller 39 is rotated at the set peripheral velocities in forming an image.

The peripheral velocities were set to be 60, 100, 150, 200 and 250 mm/sec in accordance with increase of the value of Sn max in this embodiment.

By performing such control, for example, if images with a high ratio of images are continuously outputted, the charging roller 39 rotates at a high speed and a sufficient contacting probability between the photosensitive drum 1 and the charging roller 39 and the conductive fine particulate matters m is secured even if a charging preventing factor such as toner increases. As a result, satisfactory charging without a charging defect can be performed.

In addition, since image data in the sub-scanning direction is integrated, it is possible to cope with the case where, for example, a ratio of images such as specific line images is low but image data increases in the sub-scanning direction and a charging defect in a very small area can be prevented.

If the peripheral velocity of the charging roller 39 is fixed without performing such control, it is necessary to rotate the charging roller 39 at 250 mm/sec, for example, in this embodiment, and an amount of wear of the photosensitive drum 1 increases so much more for that. However, the amount of wear of the photosensitive drum 1 was reduced and its life was successfully extended by performing the control described in this embodiment.

Third Embodiment

Figure 6:
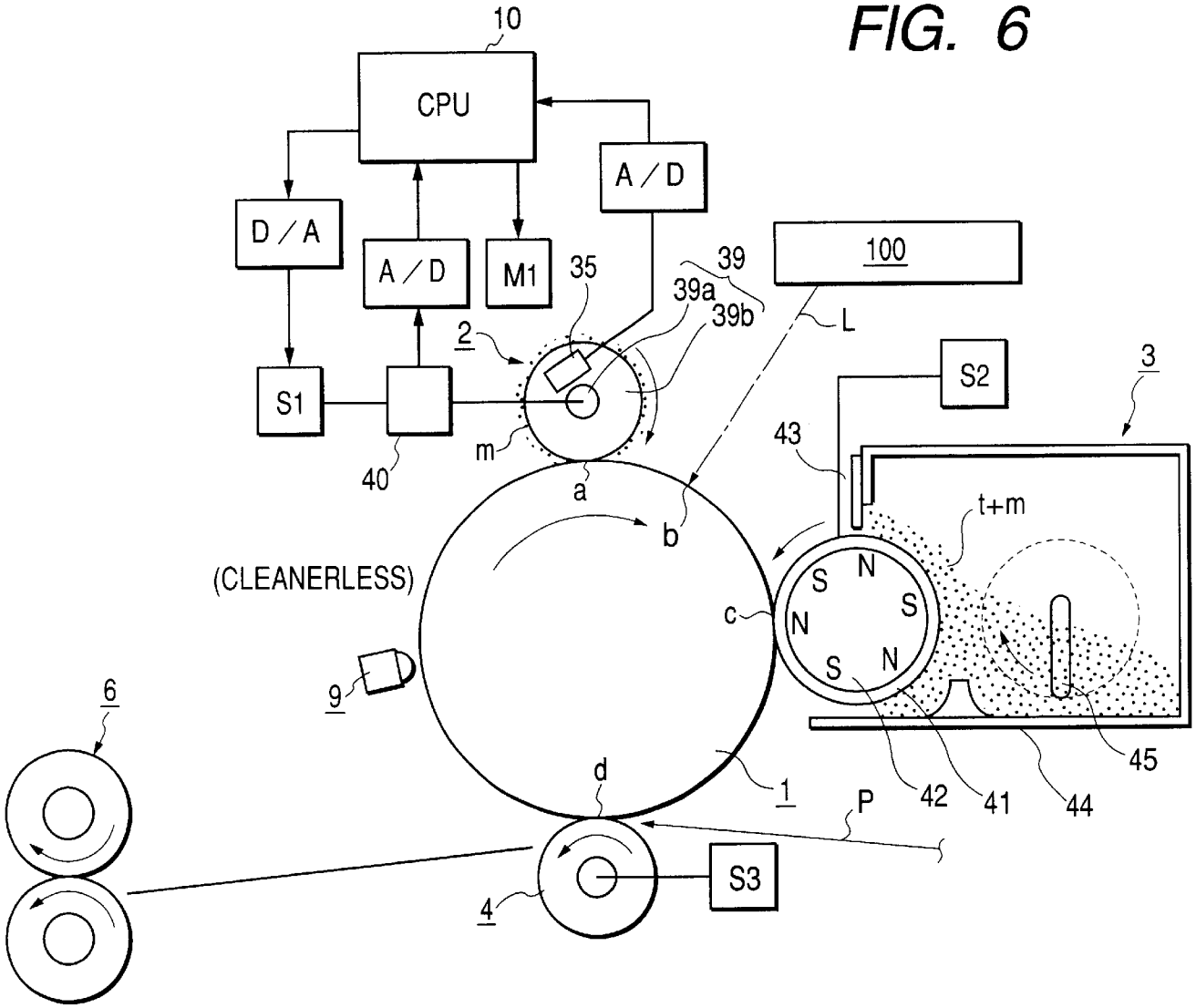
FIG. 6 is a schematic view showing a configuration of an image forming apparatus (cleanerless) of a third embodiment.

FIG. 6 is a schematic view showing a configuration of an image forming apparatus in this embodiment.

This image forming apparatus is altered from the image forming apparatus of the cleanerless system of the second embodiment such that the number of rotations of the charging roller 39 is controlled based on an amount of current flowing into the charging roller 39. Since other parts of the apparatus configuration are the same as those in the image forming apparatus of the second embodiment, their repeated descriptions are omitted.

The charging roller 39 is applied a direct current voltage of −700V from the power source S1 and is provided with amount of current detecting means 40, with which a charging current can be detected. Detected data of the amount of current detecting means 40 is supplied to the CPU 10. The optical number of rotation detecting apparatus 35 is provided on the rotary shaft of the charging roller 39. A current flown to the motor M1 for rotatably driving the charging roller 39 is controlled by the CPU 10 according to a detected amount of the number of rotation detecting apparatus 35, whereby a desired number of rotations of the charging roller 39 can be obtained.

That is, when a charging preventing factor such as toner contaminates the charging roller 39, a charging path via the charging roller 39 or the conductive fine particulate matters m is hindered and an amount of current decreases to cause a charging defect. In this embodiment, the peripheral velocity of the charging roller 39 for detecting a charging current to make the charging current constant was controlled in a range of 60 to 250 mm/sec. With such control, an effect that was substantially the same as that of the second embodiment was also realized and the life of the photosensitive drum 1 was successfully extended.

Others

1) An image bearing member may be either one in which discharging property is predominant or one in which injection charging property is predominant.

A layer consisting of a material of $10^9$ to $10^{14}$ Ω·cm is provided on a surface of an image bearing member, whereby the image bearing member can be formed as one in which contact injection charging property is predominant. For example, this is an image bearing member having a photosensitive layer and a surface layer that is turned into a resin layer (charge injecting layer) on which conductive particles such as $SnO_2$ are scattered. Even if the charge injecting layer is not used, the image bearing member can be formed as one in which the contact injection charging property is predominant, for example, in the case where a charge transport layer of a photosensitive member is within the above-mentioned range of a resistance. An equivalent effect can be obtained when an amorphous silicon photosensitive member or the like with a volume resistance of a surface layer of approximately $10^{13}$ (Ω·cm) is used.

2) An image bearing member is not limited to a photosensitive member and may be an electrostatic recording dielectric or the like. In this case, electricity is selectively removed from the uniformly charged surface of the image bearing member by electricity removing means such as an electricity removing needle array or an electron gun to form an electrostatic latent image.

3) A contact electrifying apparatus for charging an image bearing member is not limited to the magnetic brush contact electrifying apparatus of the first embodiment and the contact injection electrifying apparatus using the nonmagnetic conductive fine particulate matters of the second and the third embodiments and a fur brush, a sponge roller or other contact electrifying apparatuses accompanying injection charging or discharge can be applied without any problem.

4) A developing method of a developing apparatus may be any developing method as well. In general, a developing method of an electrostatic latent image is roughly divided into four types, namely, a method of coating nonmagnetic toner on a developer carrying member such as a sleeve by a blade or the like or coating magnetic toner on the developer carrying member by a magnetic force to carry and apply it to an image bearing member in a non-contacting state to develop an electrostatic latent image (one-component non-contact development); a method of applying toner coated on the developer carrying member as described above to an image bearing member in a contacting state to develop an electrostatic latent image (one-component contact development); a method of using toner particles mixed with a magnetic carrier as developer (two-component developer), carrying the developer by a magnetic force and applying it to an image bearing member in a contacting state to develop an electrostatic latent image (two-component contact development); and a method of applying the above-mentioned developer to an image bearing member in a non-contacting state to develop an electrostatic latent image (two-component non-contact development).

5) The transferring means 4 is not limited to roller transfer and may be any transferring means such as belt transfer, corona discharge transfer and pressure transfer.

6) The image forming apparatus of this embodiment may be an image forming apparatus that uses intermediate transferring means such as a transferring drum or a transferring belt to form not only a single color image but also a multi-color or full color image by multiple transfer or the like.

As described above, according to this embodiment, a degree of contamination of a charging member due to toner or externally added agent and integrated values of a charging current and an image output density are detected to make a velocity difference between an image bearing member and a charging member variable based on a result of the detection, whereby it becomes unnecessary to set the image bearing member and the charging member at a velocity difference assuming contamination. Conventionally, since the image bearing member and the charging member are fixed to an initially set velocity difference and have a more than necessary velocity difference even if the charging member is not contaminated, unnecessary wearing occurs. With this embodiment, a velocity difference between a charging member and an image bearing member was made variable and contamination of the charging member was detected to always control the velocity difference within a proper range, whereby unnecessary wearing was successfully eliminated to realize an extended life of the image bearing member.

As many apparently widely different embodiments of the present invention can be made without departing from the spirit and scope thereof, it is to be understood that the invention is not limited to the specific embodiments thereof except as defined in the appended claims.

What is claimed is:

1. An image forming apparatus comprising:

an image bearing member;

a charging member, disposed so as to be contactable with said image bearing member, for charging said image bearing member with a peripheral velocity difference between said charging member and said image bearing member; and controlling means for variably controlling the peripheral velocity difference at a time when an area which becomes an image forming area of said image bearing member is charging by said member.

2. An image forming apparatus according to claim 1, wherein said controlling means variably controls the peripheral velocity difference based on a current flowing between said image bearing member and said charging member.

3. An image forming apparatus according to claim 1, further comprising:

electrostatic image forming means for forming an electrostatic image in response to an image signal on said image bearing member charged by said charging member, wherein said controlling means variably controls the peripheral velocity difference based on an integrated value of the image signal.

4. An image forming apparatus according to claim 1, wherein said charging member includes magnetic particles contacting said image bearing member.

5. An image forming apparatus according to claim 4, wherein said charging member includes a carrying member for carrying said magnetic particles and the peripheral velocity difference is a peripheral velocity difference between said image bearing member and said carrying member.

6. An image forming apparatus according to claim 1, wherein said charging member includes conducting particles contacting said image bearing member and a flexible carrying member carrying said conducting particles and forming a nip portion with said image bearing member.

7. An image forming apparatus according to claim 6, wherein the peripheral velocity difference is a peripheral velocity difference between said image bearing member and said carrying member.

8. An image forming apparatus according to claim 6, wherein a foam layer is provided on a surface of said carrying member.

9. An image forming apparatus according to claim 1, wherein said charging member includes a fabric brush.

10. An image forming apparatus according to claim 1, wherein said charging member moves in a direction, which is reverse to a moving direction of said image bearing member in a contacting portion of said image bearing member and said charging member.

11. An image forming apparatus according to claim 1, wherein a voltage is applied to said charging member.

12. An image forming apparatus according to claim 1, further comprising:

electrostatic image forming means for forming an electrostatic image on said image bearing member charged by said charging member; and developing means for developing the electrostatic image with toner, wherein said developing means is capable of collecting residual toner from said image bearing member.

13. An image forming apparatus according to claim 1, further comprising:

electrostatic image forming means for forming an electrostatic image on said image bearing member charged by said charging member;

developing means for developing the electrostatic image with toner; and transferring means for transferring a toner image formed on said image bearing member to a transfer material.

14. An image forming apparatus according to claim 1, wherein said image bearing member includes a surface layer having a resistance of $10^9$ to $10^{14}$ Ωcm and a photosensitive layer provided inside of said surface layer.

15. An image forming apparatus according to claim 1, wherein said image bearing member includes an amorphous silicon photosensitive layer.

16. An image forming apparatus comprising:

an image bearing member;

a charging member, disposed so as to be contactable with said image bearing member, for charging said image bearing member with a peripheral velocity difference between said charging member and said image bearing member; and controlling means for variably controlling the peripheral velocity difference based on a current flowing between said image bearing member and said charging member.

17. An image forming apparatus according to claim 16, further comprising:

electrostatic image forming means for forming an electrostatic image in response to an image signal on said image bearing member charged by said charging member, wherein said controlling means variably controls the peripheral velocity difference based on an integrated value of the image signal.

18. An image forming apparatus according to claim 16, wherein said charging member includes magnetic particles contacting said image bearing member.

19. An image forming apparatus according to claim 18, wherein said charging member includes a carrying member for carrying said magnetic particles and the peripheral velocity difference is a peripheral velocity difference between said image bearing member and said carrying member.

20. An image forming apparatus according to claim 16, wherein said charging member includes conducting particles contacting said image bearing member and a flexible carrying member carrying said conducting particles and forming a nip portion with said image bearing member.

21. An image forming apparatus according to claim 20, wherein the peripheral velocity difference is a peripheral velocity difference between said image bearing member and said carrying member.

22. An image forming apparatus according to claim 20, wherein a foam layer is provided on a surface of said carrying member.

23. An image forming apparatus according to claim 16, wherein said charging member includes a fabric brush.

24. An image forming apparatus according to claim 16, wherein said charging member moves in a direction, which is reverse to a moving direction of said image bearing member in a contacting portion of said image bearing member and said charging member.

25. An image forming apparatus according to claim 16, wherein a voltage is applied to said charging member.

26. An image forming apparatus according to claim 16, further comprising:

electrostatic image forming means for forming an electrostatic image on said image bearing member charged by said charging member; and developing means for developing the electrostatic image with toner, wherein said developing means is capable of collecting residual toner from said image bearing member.

27. An image forming apparatus according to claim 16, further comprising:

electrostatic image forming means for forming an electrostatic image on said image bearing member charged by said charging member;

developing means for developing the electrostatic image with toner; and transferring means for transferring a toner image formed on said image bearing member to a transfer material.

28. An image forming apparatus according to claim 16, wherein said image bearing member includes a surface layer having a resistance of $10^9$ to $10^{14}$ Ωcm and a photosensitive layer provided inside of said surface layer.

29. An image forming apparatus according to claim 16, wherein said image bearing member includes an amorphous silicon photosensitive layer.

30. An image forming apparatus comprising:

an image bearing member;

a charging member, disposed so as to be contactable with said image bearing member, for charging said image bearing member with a peripheral velocity difference between the charging member and said image bearing member;

electrostatic image forming means for forming an electrostatic image in response to an image signal on said image bearing member charged by said charging member; and controlling means for variably controlling the peripheral velocity difference based on an integrated value of the image signal.

31. An image forming apparatus according to claim 30, wherein said charging member includes magnetic particles contacting said image bearing member.

32. An image forming apparatus according to claim 31, wherein said charging member includes a carrying member for carrying said magnetic particles and the peripheral velocity difference is a peripheral velocity difference between said image bearing member and said carrying member.

33. An image forming apparatus according to claim 30, wherein said charging member includes conducting particles contacting said image bearing member and a flexible carrying member carrying said conducting particles and forming a nip portion with said image bearing member.

34. An image forming apparatus according to claim 33, wherein the peripheral velocity difference is a peripheral velocity difference between said image bearing member and said carrying member.

35. An image forming apparatus according to claim 33, wherein a foam layer is provided on a surface of said carrying member.

36. An image forming apparatus according to claim 30, wherein said charging member includes a fabric brush.

37. An image forming apparatus according to claim 30, wherein said charging member moves in a direction, which is reverse to a moving direction of said image bearing member in a contacting portion of said image bearing member and said charging member.

38. An image forming apparatus according to claim 30, wherein a voltage is applied to said charging member.

39. An image forming apparatus according to claim 30, further comprising developing means for developing said electrostatic image with toner, wherein said developing means is capable of collecting residual toner from said image bearing member.

40. An image forming apparatus according to claim 30, further comprising:

developing means for developing the electrostatic image with toner; and transferring means for transferring a toner image formed on said image bearing member to a transfer material.

41. An image forming apparatus according to claim 30, wherein said image bearing member includes a surface layer having a resistance of $10^9$ to $10^{14}$ Ωcm and a photosensitive layer provided inside of said surface layer.

42. An image forming apparatus according to claim 30, wherein said image bearing member includes an amorphous silicon photosensitive layer.

* * * * *